US006537142B2

(12) United States Patent
Liou

(10) Patent No.: US 6,537,142 B2
(45) Date of Patent: Mar. 25, 2003

(54) BELT ADJUSTING DEVICE OF BELT SANDER

(76) Inventor: John Liou, No. 4, Alley 57, Lane 80, Feng Chung Rd., Feng Yuan City, Taichung Hsien (TW)

( * ) Notice: Subject to any disclaimer, the term of this patent is extended or adjusted under 35 U.S.C. 154(b) by 0 days.

(21) Appl. No.: 09/842,132

(22) Filed: Apr. 26, 2001

(65) Prior Publication Data

US 2002/0151261 A1 Oct. 17, 2002

(30) Foreign Application Priority Data

Apr. 12, 2001 (TW) ..... 90205690 U

(51) Int. Cl.[7] ..... B24B 21/00
(52) U.S. Cl. ..... 451/311; 451/297
(58) Field of Search ..... 451/311, 304, 451/297, 296, 458, 489

(56) References Cited

U.S. PATENT DOCUMENTS 3,118,314 A * 1/1964 Schuster ..... 74/241
3,538,650 A * 11/1970 Pollak ..... 451/311
3,909,987 A * 10/1975 MacCarthy, Sr. ..... 451/311
4,939,870 A * 7/1990 Wang ..... 451/296
5,185,962 A * 2/1993 Liou ..... 451/311
6,299,512 B1 * 10/2001 Costa ..... 451/59

* cited by examiner

*Primary Examiner*—Robert A. Rose
(74) *Attorney, Agent, or Firm*—Browdy and Neimark

(57) ABSTRACT

A belt adjusting device of the belt sander comprises a seat on which a driving roller and a driven roller are pivotally mounted. A reduction gear set is mounted on the seat and is driven by a motor. The gear set is provided with a shaft rod capable of turning in the direction perpendicular to the motor spindle and having one end which is disposed in a long slot of a swiveling member. When the shaft rod slides in the long slot, the push portion of other end of the swiveling member is caused to swivel a predetermined angle, so as to push an action rod in constant contact with the swiveling member to act. The action rod is pivoted with the driven roller. When the action rod is pushed, the free end of the driven roller is caused to engage in an up-and-down displacement perpendicular to the motor spindle. The sanding belt can be thus displaced horizontally on the two rollers to adjust automatically the contact position between the sanding belt and a workpiece.

5 Claims, 4 Drawing Sheets

BELT ADJUSTING DEVICE OF BELT SANDER

FIELD OF THE INVENTION

The present invention relates generally to a belt sander, and more particularly to a belt adjusting device of the belt sander.

BACKGROUND OF THE INVENTION

The conventional sanding machine comprises a machine base which is provided at both ends with a driving roller pivoted thereto, and a driven roller pivoted thereto. A sanding belt is fitted with the outer edges of these two rollers. The driving roller is driven by a motor to actuate the sanding belt to move. A workpiece to be finished is brought to make contact with the sanding belt in motion such that the workpiece must be moved around from time to time to prevent the surface of the sanding belt from being worn out unevenly, thereby prolonging the service life span of the sanding belt. In addition, the prolonged contact of the workpiece with a constant point of the sanding belt can result in the burning of the workpiece.

SUMMARY OF THE INVENTION

It is the primary objective of the present invention to provide a belt sander with a belt adjusting device enabling the sanding belt to be adjusted leftwards and rightwards, so as to alleviate the work load of an operator.

It is another objective of the present invention to provide a belt sander with a belt adjusting device which is provided with means to adjust automatically the displacement of the sanding belt so as to change the contact position between a workpiece and the sanding belt, thereby preventing a local burning of the workpiece.

It is still another objective of the present invention to provide a belt sander with a belt adjusting device enabling the sanding belt to be put to use uniformly, so as to prolong the service life span of the sanding belt.

In keeping with the principle of the present invention, the foregoing objectives of the present invention are attained by the belt adjusting device, which comprises a seat, a sanding belt, a reduction gear set, a swiveling member, and an action rod. The seat is provided respectively at both ends thereof with a driving roller and a driven roller. The driving roller is driven by a motor. The driven roller is mounted at one end on the seat. Both the driving roller and the driven roller have a free end. The sanding belt is movably fitted with the outer edges of the two rollers. The reduction gear set is mounted on the free end of the driving roller and is formed of a plurality of reduction gears and a shaft rod. The shaft rod is actuated to turn by the reduction gears which are driven by the motor. The swiveling member is provided at one end with a long slot, and at other end thereof with a push portion. The shaft rod is pivotally put through the long slot such that the shaft rod slides in the long slot so as to enable the push portion to swivel in a predetermined angle. The action rod is movably disposed at one side of the seat such that the action rod is capable of a left horizontal displacement and a right horizontal displacement. The action rod is pivotally fastened at one end with the free end of the driven roller such that other end of the action rod is in a constant contact with the push portion of the swiveling member. As the action rod is pushed by the push portion to slide, the free end of the driven roller is pushed by the action rod to displace up and down.

The sanding belt can be thus moved on the two rollers to facilitate the adjusting of the contact position of the sanding belt in relation to a workpiece.

DETAILED DESCRIPTION OF THE INVENTION

Figure 1:
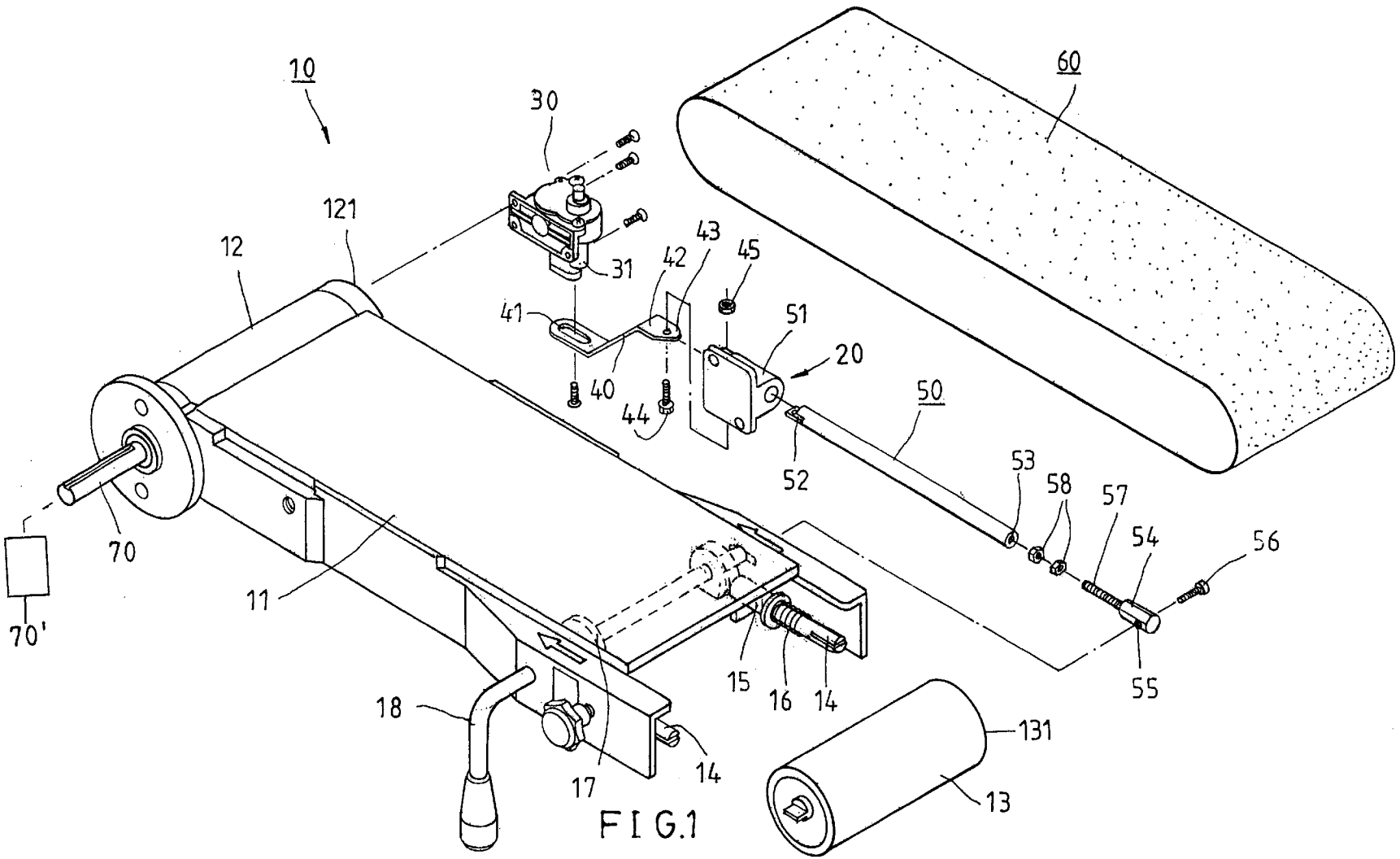
FIG. 1 shows an exploded view of a belt adjusting device of a belt sander of the present invention.
Figure 2:
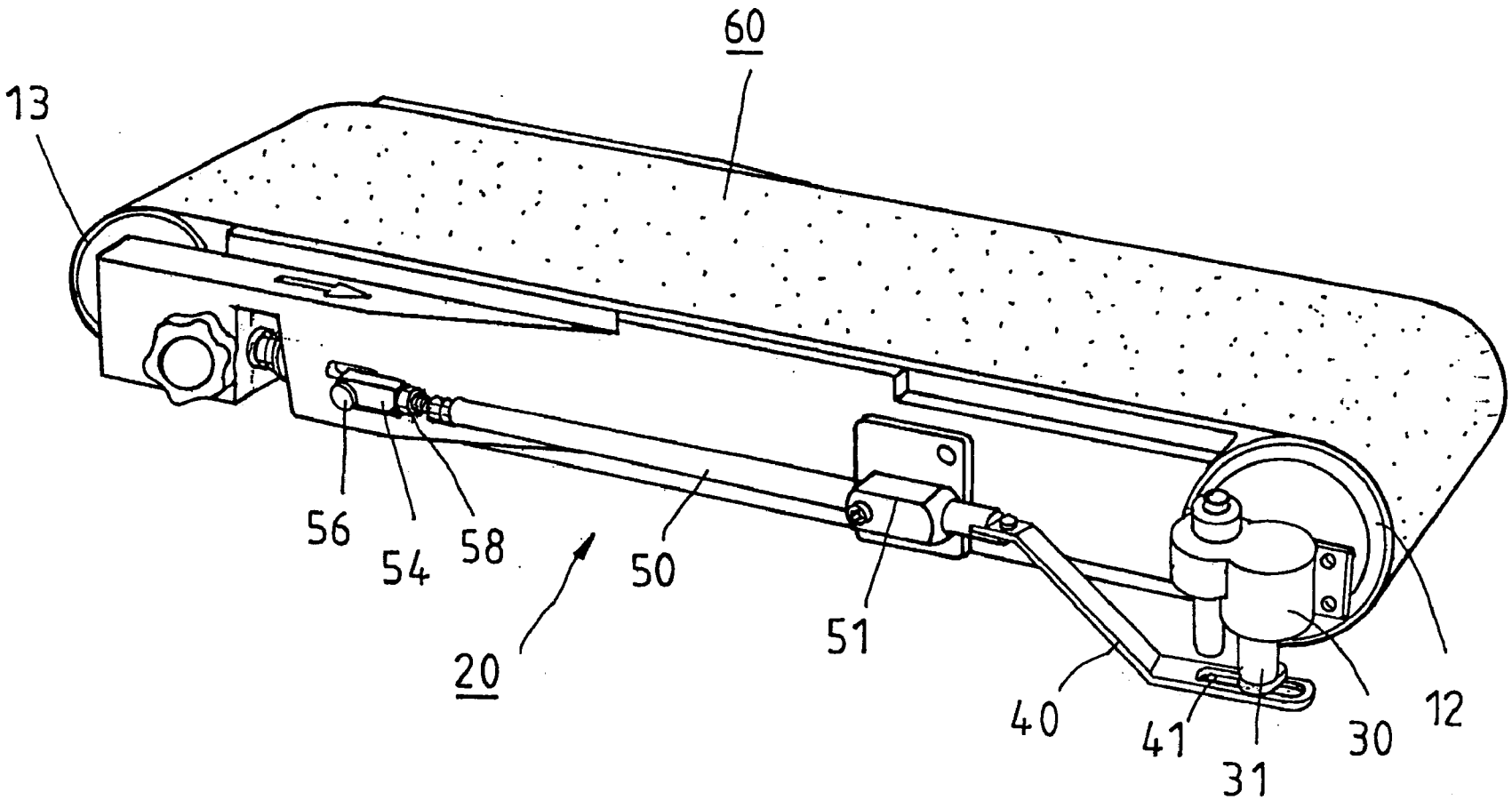
FIG. 2 shows a rear perspective view of the present invention in combination.

As shown in FIGS. 1 and 2, a belt adjusting device 20 of the present invention is mounted in one side of a belt sander 10 which is basically similar in construction to the conventional belt sander and is formed of a seat 11, which is provided respectively at two ends with a driving roller 12 pivoted thereto, and a driven roller 13 pivoted thereto. An endless sanding belt 60 is fitted with the outer peripheries of the two rollers 12 and 13. The driving roller 12 has a free end 121 and is fastened pivotally at other end thereof with a spindle 70 of a motor 70'. The driving roller 12 is driven by the motor 70' to turn. The driven roller 13 is mounted at both ends thereof on two support rods 14 of the seat 11. The support rods 14 are in turn connected with a sleeve 15, a spring 16, two cams 17, and a wrenching rod 18, thereby enabling the driven roller 13 to be displaced inwards to shorten the distance between the driving roller 12 and the driven roller 13 so as to facilitate the releasing of the sanding belt 60. These structures are disclosed by this inventor of the present invention in the U.S. Pat. No. 5,185,962 and are not the features of the present invention.

As shown in FIG. 2, the adjusting device 20 is disposed on one side of the seat 11 and is located at the free ends 121 and 131 of the driving roller 12 and the driven roller 13. The device 20 comprises a reduction gear set 30, a swiveling member 40, and an action rod 50.

The reduction gear set 30 comprises a plurality of reduction gears (not shown in the drawing) and a shaft rod 31. The reduction gears are in contact with the spindle 70 of the motor 70' and are driven by the motor 70' to actuate the shaft rod 31 to extend in the direction perpendicular to the spindle 70, so as to turn in an eccentric pattern.

The swiveling member 40 is a rod member of a Z-shaped construction and is provided in the horizontal portion of one end thereof with a long slot 41, and in the horizontal portion of other end thereof with a push portion 42. The shaft rod 31 is pivotally put through the long slot 41. The push portion 42 has a triangular construction and is provided with a through hole 43 for receiving a bolt 44 which is engaged with a nut 45. The rotation of the shaft rod 31 is thus confined by the long slot 41 such that the shaft rod 31 slides in the long slot 41, thereby enabling the push portion 42 to swivel in a predetermined angle.

Figure 4:
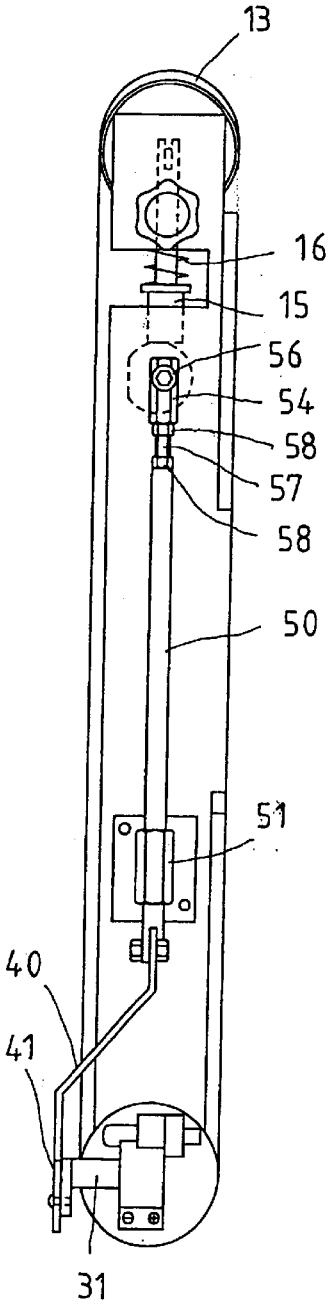
FIG. 4 is a side schematic view of the present invention as shown in FIG. 3.

The action rod 50 has a predetermined length and is disposed on a slide seat 51 of one side of the seat 11 such that the action rod 50 is slidably disposed between the driving roller 12 and the driven roller 13. The action rod 50 is provided at one end with a slanted insertion slot 52 corresponding to the push portion 42 of the swiveling member 40. The push portion 42 is inserted into the insertion slot 52, as indicated in FIG. 4, thereby enabling the action rod 50 to remain constantly in contact with the swiveling member 40. When the push portion 42 swivels, the action rod 50 is pushed to displace by the bevel push principle. The action rod 50 is provided at other end with an inner threaded hole 53. A pivoting member 54 is provided at one end with a through hole 55 and is fastened with the end of the wrenching rod 18 by a bolt 56. The pivoting member is provided at other end with an outer threaded section 57 which is first provided with two nuts 58 before being engaged with the inner threaded hole 53 of the action rod 50. As the action rod 50 slides, the sleeve 15 is pushed to move up and down, thereby actuating the free end 131 of the driven roller 13 to displace in an up-and-down direction perpendicular to the motor spindle 70. As the nuts 58 are unfastened, the connection length of the pivoting member 54 and the action rod 50 can be changed. As a result, the distance of the up-and-down displacement of the driven roller 13 can be changed.

Figure 3:
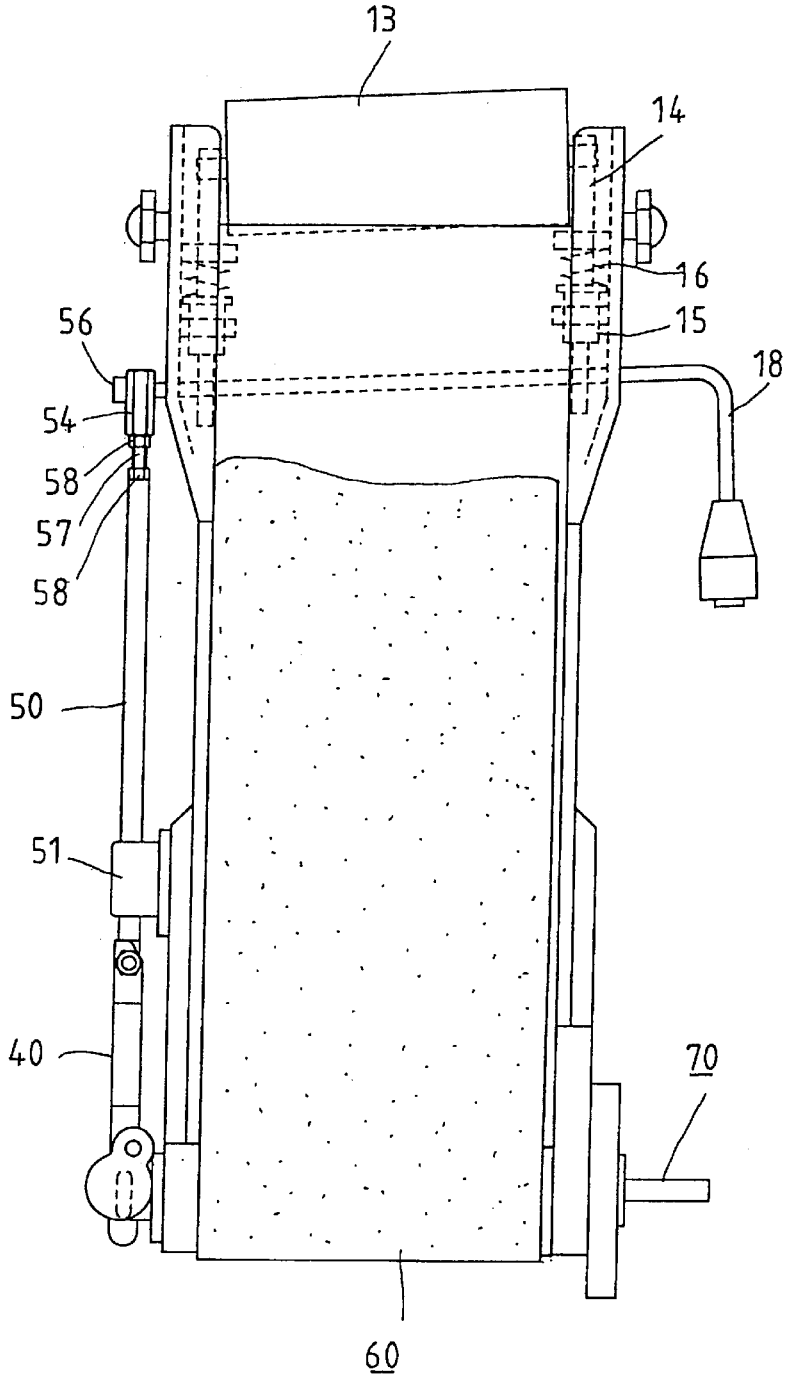
FIG. 3 shows a schematic plan view of the present invention in action.

As shown in FIGS. 3 and 4, when the spindle 70 of the motor 70' is started to rotate, the driving roller 12, the driven roller 13, and the shaft rod 31 of the reduction gear set 30 are driven to rotate synchronously. The sanding belt 60 turns between the driving roller 12 and the driven roller 13. In the meantime, the shaft rod 31 is engaged at the outer side of the long slot 41 of the swiveling member 30. The action rod 50 is linked to move in the direction toward the driving roller 12, thereby causing the support rod 16, which is pivoted to the driven roller 13, to be pulled downwards. As a result, the free end 131 of the driven roller 13 is lower in level than one end of the wrenching rod 18, thereby causing the sanding belt 60 to slide downwards from the free end 131 of the driven roller 13.

Figure 6:
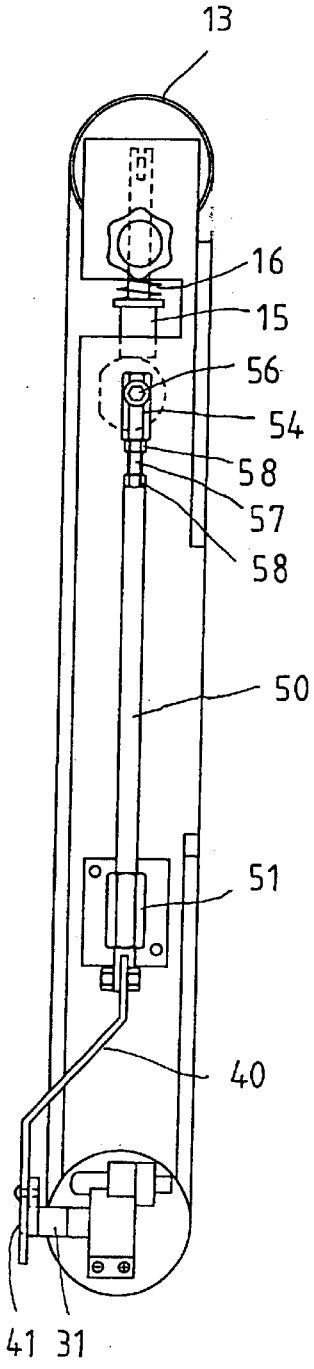
FIG. 6 is a side schematic view of the present invention as shown in FIG. 5.
Figure 5:
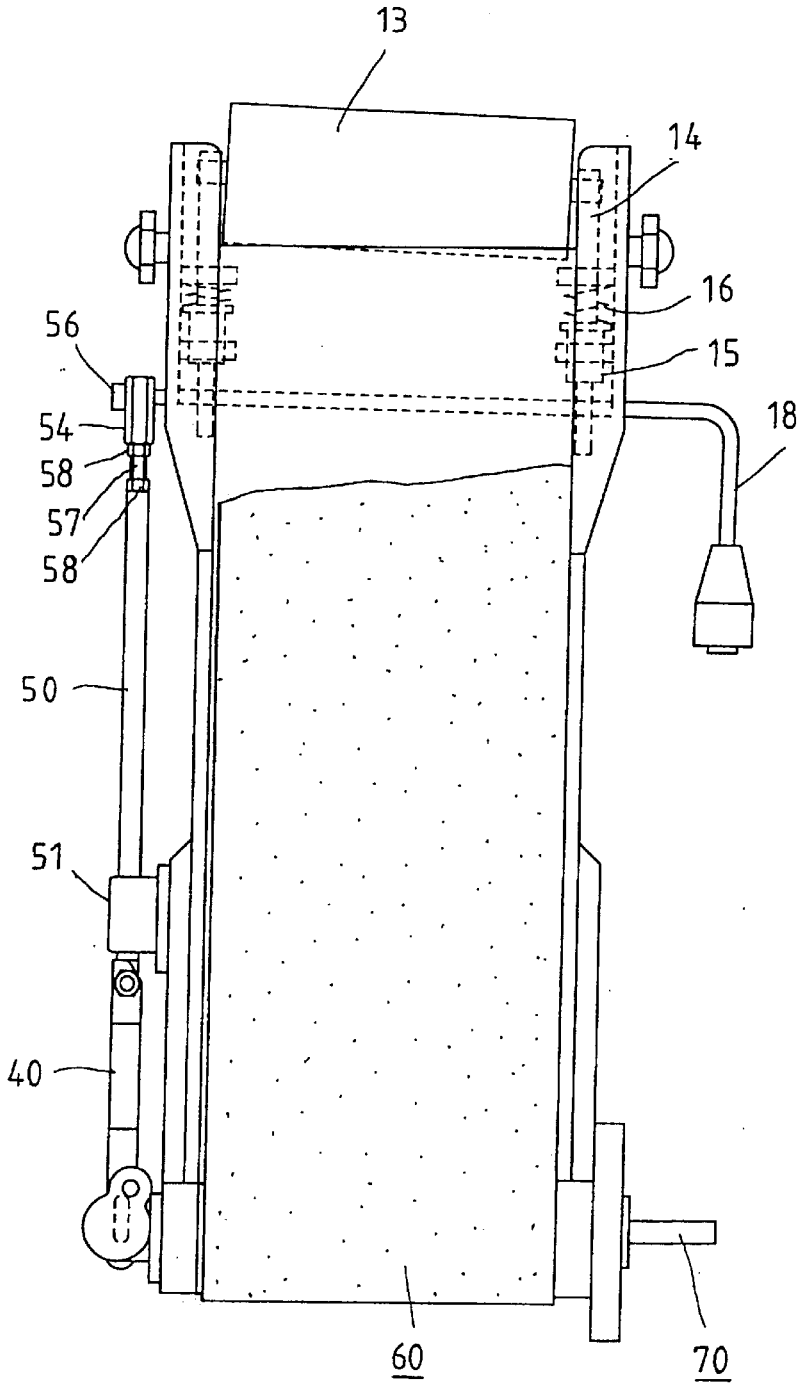
FIG. 5 shows another schematic plan view of the present invention in action.

When the shaft rod 31 is engaged at the inner side of the long slot 41 of the swiveling member 40, as shown in FIGS. 5 and 6, the action rod 50 is pushed by the push portion 42 of the swiveling member 40 so as to move in the direction toward the driven roller 13. As a result, the support rod 16, which is pivoted to the driven roller 13, is pushed upwards. The free end 131 of the driven roller 13 is relatively higher in level than one end of the wrenching rod 18. The sanding belt 60 slides downwards toward the opposite end of the free end 131 of the driven roller 13.

The sanding belt 60 is caused to slide toward the lower place by means of the up-and-down displacement of the free end 131 of the driven roller 13. As a result, the sanding belt 60 can be horizontally moved leftwards and rightwards on the two rollers 12 and 13. The operator does not have to move the workpiece leftwards and rightwards. The adjusting device 20 of the present invention is capable of adjusting automatically the contact position of the sanding belt 60 and the workpiece. The work load of the operator is thus alleviated. In addition, the contact position between the workpiece and the sanding belt 60 can be changed from time to time, so as to prevent the overheating and the burning of the workpiece. Moreover, the sanding belt 60 is evenly used in its entirety to prevent the sanding belt from being locally worn out.

The seat 11 of the present invention may be directly fastened with a lug (not shown in the drawings) which is disposed in proximity of the push portion 42 of the swiveling member 40 and is intended for use in pivoting the push portion 42 of the swiveling member 40 to stabilize the swiveling member 40 in motion.

The present invention described above is to be regarded in all respects as being merely illustrative and not restrictive. Accordingly, the present invention may be embodied in other specific forms without deviating from the spirit thereof. The present invention is therefore to be limited only by the scopes of the following claims.

What is claimed is:

1. A belt adjusting device for a belt sander, comprising:

a seat provided respectively at two ends with a driving roller rotatable thereon, and a driven roller rotatable thereon, said driving roller pivoted at one end thereof with a motor spindle adapted to engage a motor and provided at the other end thereof with a free end, said driven roller being mounted at one end thereof on said seat and provided at the other end thereof with a free end;

a sanding belt movably fitted with outer peripheries of said two rollers;

a reduction gear set mounted on said free end of said driving roller and formed of a plurality of reduction gears and a shaft rod, said reduction gears being driven by said motor to actuate said shaft rod to rotate;

a swiveling member provided at one end thereof with a long slot, and at the other end thereof with a push portion, said long slot intended for use in putting pivotally therethrough said shaft rod capable of sliding in said long slot to enable said push portion to swivel a predetermined angle; and an action rod disposed in one side of said seat such that said action rod is slidably disposed between said driving roller and said driven roller, and that said action rod is pivotally fastened at one end thereof with said free end of said driven roller, and further that the other end of said action rod is constantly in contact with said push portion of said swiveling member, thereby enabling said action rod to be pushed by said push portion to slide so as to push said free end of said driven roller to engage in an up-and-down displacement perpendicular to said motor spindle.

2. The belt adjusting device as defined in claim 1, wherein said shaft rod of said reduction gear set is set up in such a manner that said shaft rod extends in a direction perpendicular to said motor spindle; wherein said swiveling member is of a Z-shaped construction, said action portion and said long slot being disposed in a horizontal portion of two ends thereof.

3. The belt adjusting device as defined in claim 2, wherein said push portion of said swiveling member is of a triangular construction; wherein said action rod is provided with an insertion slot corresponding to and engageable with said push portion.

4. The belt adjusting device as defined in claim 2, wherein said push portion of said swiveling member is provided with a through hole and a bolt which is put through said through hole to mount said push portion on a lug on one side of said seat.

5. The belt adjusting device as defined in claim 1, wherein said end of said action rod in contact with said driven roller is provided with an inner threaded hole; wherein said driven roller is fastened with one end of a pivoting member, with the other end of said pivoting member being provided with an outer threaded section which is engaged with two nuts and said inner threaded hole, thereby enabling the distance of the up-and-down displacement of said driven roller to be changed by adjusting a connection length of said pivoting member and said action rod.

* * * * *